US007891652B2

(12) United States Patent
Mandel et al.

(10) Patent No.: US 7,891,652 B2
(45) Date of Patent: Feb. 22, 2011

(54) SHEET COMPILING SYSTEM AND METHOD

(75) Inventors: Barry P Mandel, Fairport, NY (US); Steven R Moore, Pittsford, NY (US); Martin Krucinski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 287 days.

(21) Appl. No.: 12/023,635

(22) Filed: Jan. 31, 2008

(65) Prior Publication Data

US 2009/0194927 A1 Aug. 6, 2009

(51) Int. Cl.
*B65H 37/04* (2006.01)

(52) U.S. Cl. ..... 270/58.17; 270/58.02; 270/58.07; 270/58.11; 270/58.12; 270/58.27

(58) Field of Classification Search ..... 270/1.01, 270/18, 32, 45, 58.01, 58.02, 58.07, 58.11, 270/58.12, 58.16, 58.17, 58.27
See application file for complete search history.

(56) References Cited

U.S. PATENT DOCUMENTS 5,350,169 A 9/1994 Hiroi et al.
7,413,181 B2 * 8/2008 Iida et al. ..... 270/58.12
7,665,730 B2 * 2/2010 Funada ..... 271/250
2003/0085511 A1 5/2003 Saito et al.
2006/0120784 A1 * 6/2006 Iida et al. ..... 399/407
2006/0181006 A1 * 8/2006 Funada ..... 271/207

FOREIGN PATENT DOCUMENTS

EP 0 814 385 A2 12/1997
JP 04331170 A * 11/1992

OTHER PUBLICATIONS

U.S. Appl. No. 11/784,644, filed Apr. 9, 2007, Moore.

* cited by examiner

*Primary Examiner*—Leslie A Nicholson, III
(74) *Attorney, Agent, or Firm*—Fay Sharpe LLP

(57) ABSTRACT

A compiling unit includes a collection tray and a variable-speed compiling system adapted to operate at at least two speeds to thereby receive a sheet of media at a higher speed and register the sheet of media within the collection tray at a lower speed. A control system is adapted to selectively operate the variable-speed compiling system at the at least two speeds. A printing system having a sheet media source, at least one marking engine, such a compiling unit and such a control system is included. A method of compiling sheet media is also included.

26 Claims, 6 Drawing Sheets

SHEET COMPILING SYSTEM AND METHOD

BACKGROUND

The subject matter of the present disclosure broadly relates to the art of sheet compiling systems and, more particularly, to a variable-speed compiling system, such as may be used as a post-processing collator or in association with a finishing unit of a printing system, for example, as well as a method of compiling sheet media using the same.

Sheet handling systems of many types and kinds are known to utilize sheet compiling systems to collect and organize sheets of media into one or more packets or stacks thereof. For example, printing systems are known to use finishing units of a variety of types and kinds to receive sheets of media output by a marking engine or other section of the printing system. Typically, such known finishing units operate to organize the sheets of media into one or more packets or groups of sheets, such as into collated or uncollated stacks, for example. In many cases, known finishing units are also adapted to perform one or more further operations on these one or more groups of sheets, such as stapling or hole punching operations, for example.

Typically, it is desirable for known finishing units to at least approximately align one or more edges of the sheets of media in each group so that any further operations will produce uniform output. For example, it is often desirable to approximately align two adjacent edges of the sheets of media prior to a stapling operation such so that the resulting stapled packets of media will have a uniform appearance. As another example, it is normally desirable to approximately align two adjacent edges of the sheet of media prior to a hole punching operation so that all of the sheets of media will be hole punched in approximately the same locations, which will permit the sheets of media to be inserted, such as in an associated binder, in a uniform manner.

Known finishing units and other sheet handling systems commonly include a compiler or compiling system to assist in approximately aligning the sheets of media with one another. Typically, such compilers will include at least one collection tray for receiving the sheets of media. The collection tray normally includes a bottom wall for supporting the sheets of media and at least one registration wall that projects in an approximately transverse direction from the bottom wall. The at least one registration wall can then be used for approximately aligning edges of the sheets of media.

One example of such an arrangement, which is often referred to in the art as an "uphill" compiler, includes a collection tray that has bottom wall with a proximal end and a distal end. Typically, the distal end extends above the proximal end so that the bottom wall is disposed in an "uphill" orientation with respect to the sheet media being received at the finishing unit. The registration wall of the collection tray projects from the bottom wall along the proximal end thereof. Sheets of media enter the collection tray from along the proximal end such that the leading edge of the sheets of media is disposed toward the distal end of the collection tray and the trailing edge is disposed toward the proximal end of the collection tray. During use, the sheets of media are delivered into the collection tray with sufficient speed for the sheets of media to settle onto the bottom wall with the trailing edge of the sheets being spaced a short distance from the registration wall. The sheets of media then slide back toward the proximal end under the influence of gravity until the trailing edge of the sheets of media is at least approximately aligned with the registration wall.

Due to certain operational characteristics of uphill compilers, the same tend to be better suited for use in association with systems having lower output rates, such as less than 100 pages per minute (ppm), for example. This may be due, at least in part, to the time required for gravity to accelerate each sheet downhill and into approximate alignment with a registration wall. As such, the use of such uphill compilers is often avoided in sheet handling and/or printing systems that operate at higher output rates.

Other compilers or compiling systems have been developed to provide improved performance, such as the ability to handle higher printing system output rates, for example. Such compiling systems are often referred to in the art as "friction" compiling systems due to the use of an element that frictionally engages each sheet of media to urge the same toward the one or more registration walls. However, certain undesirable characteristics are often associated with known friction compiling systems.

For example, friction compilers typically include a frictional element that engages each individual sheet of media as the same is being received at or along the collection tray. The frictional element drives each sheet of media toward at least one registration wall such that at least the leading edge of successive sheets of media will be aligned with one another. One difficulty with such arrangements, however, is that causing the leading edge of the sheets of media to impact the registration wall with too much force can occasionally result in the sheet being undesirably deformed (e.g., wrinkled or folded). In other cases, such levels of impact force may result in the sheets of media bouncing back or otherwise away from the one or more registration walls. Oppositely, imparting insufficient drive force on the sheets of media can result in some of the sheets of media failing to reach the registration wall.

Accordingly, it is believed desirable to develop a compiling system for a finishing unit of a printing system and method of operating the same that overcomes the foregoing and/or other issues.

BRIEF DESCRIPTION

A compiling system in accordance with the subject matter of the present disclosure is provided that is adapted to receive sheets of media from an associated output pathway of an associated media transport system. The compiling system includes a collection tray that is adapted to receive the sheets of media. The collection tray includes at least one registration wall suitable for use in at least approximately aligning the sheets of media with one another. The compiling system also includes a sheet-engaging element operative to engage an individual sheet of media and to urge the individual sheet of media toward the at least one registration wall. The compiling system further includes a variable-speed rotation source drivably connected to the sheet-engaging element. The variable-speed rotation source is operative to selectively generate rotational output for driving the sheet-engaging element at a first speed prior to engaging the individual sheet of media and at a second speed that is less than the first speed after engaging the individual sheet of media and prior to the individual sheet of media contacting the registration wall.

A printing system in accordance with the subject matter of the present disclosure is provided that includes a sheet media source adapted to selectively dispense sheet media and at least one printing engine in operative communication with the sheet media source for receiving sheet media therefrom. The at least one printing engine is adapted to output marked sheet media. The printing system also includes a finishing unit that is disposed in operative communication with the at least one printing engine for receiving marked sheet media therefrom. The finishing unit includes a collection tray and a variable-speed compiling system. The collection tray is adapted to receive the marked sheet media and includes at least one registration surface. The variable-speed compiling system is operative to engage a sheet of media while operating at a first speed and at least approximately align the sheet of media with the at least one registration surface of the collection tray while operating at a second speed that is less than the first speed. The printing system further includes a control system that is in communication with the sheet media source, the at least one printing engine and the finishing unit. The control system operative to determine arrival of the sheet of media at the finishing unit and operate the variable-speed compiling system at the first speed prior to engaging the sheet of media. The control system is also operative to operate the variable-speed compiling system at the second speed after engaging the sheet of media and prior to the sheet of media contacting the at least one registration surface. The control system is also operative to operate the variable-speed compiling system to at least approximately align the sheet of media with the at least one registration surface.

A method of compiling sheet media in accordance with the subject matter of the present disclosure is provided that includes providing a compiling unit that is operatively disposed along a media transport pathway, which media transport pathway is adapted to convey individual sheets of media therealong at a first sheet speed. The compiling unit includes a collection tray and a variable-speed compiling system. The collection tray includes a sheet registration wall suitable for approximately aligning the individual sheets of media with one another. The method also includes receiving at the compiling unit one sheet of media traveling at the first sheet speed and engaging the one sheet of media using the variable-speed compiling system. The method further includes reducing the speed of the one sheet of media from the first sheet speed to a second sheet speed using the variable-speed compiling system prior to the one sheet of media contacting the sheet registration wall of the collection tray. The method also includes urging the one sheet of media into approximate alignment with the sheet registration wall of the collection tray using the variable-speed compiling system.

A method of compiling printed sheet media in accordance with the subject matter of the present disclosure is provided that includes providing a printing system including a sheet media source operative to output individual sheets of media, at least one printing engine operative to selectively mark the individual sheets of media and a finishing unit adapted to receive and compile the individual sheets of media. The finishing unit includes a collection tray and a variable-speed compiling system. The collection tray includes a sheet registration wall suitable for approximately aligning the individual sheets of media with one another. The method also includes receiving at the finishing unit one of the individual sheets of media traveling at a first sheet speed and engaging the one sheet of media using the variable-speed compiling system. The method further includes reducing the speed of the one sheet of media from the first sheet speed to a second sheet speed using the variable-speed compiling system prior to the one sheet of media contacting the sheet registration wall of the collection tray. The method also includes urging the one sheet of media into approximate alignment with the sheet registration wall of the collection tray using the variable-speed compiling system.

DETAILED DESCRIPTION

As discussed above, it will be appreciated that the subject matter of the present disclosure is broadly applicable for use in association with sheet handling and/or transporting systems of any suitable type, kind, configuration and/or construction. As one example, the subject matter of the present disclosure will the shown and described herein with specific reference to use in association with printing systems. It is to be clearly understood, however, that such use is merely exemplary and is not intended to be limiting.

The terms "print", "printing" and "marking" as used herein are to be broadly interpreted to encompass any action or process involving the production and/or output of sheet media having text, images, graphics and/or other indicia formed thereon by any process, such as inkjet or electrophotographic processes, for example.

The terms "printer" and "printing system" as used herein are to be broadly interpreted to encompass any device, apparatus or system that is capable of performing a "printing" action. Examples of such equipment and/or systems include, without limitation, desktop printers, network printers, stand-alone copiers, multi-function printer/copier/facsimile devices, high-speed printing/publishing systems and digital printing presses.

Additionally, such exemplary embodiments of equipment, systems and/or processes can utilize sheet media of any suitable size, shape, type, kind, material, quality, weight and/or thickness (e.g., recycled paper, plain paper, bond paper, coated paper, card stock, transparencies and/or other media). Furthermore, such exemplary equipment, systems and/or processes can output indicia on such sheet media using any printing or marking substance, such as liquid ink, solid ink, toner and/or colorant, for example, in monochrome (e.g., black) or one or more colors, or any combination thereof.

Figure 1:
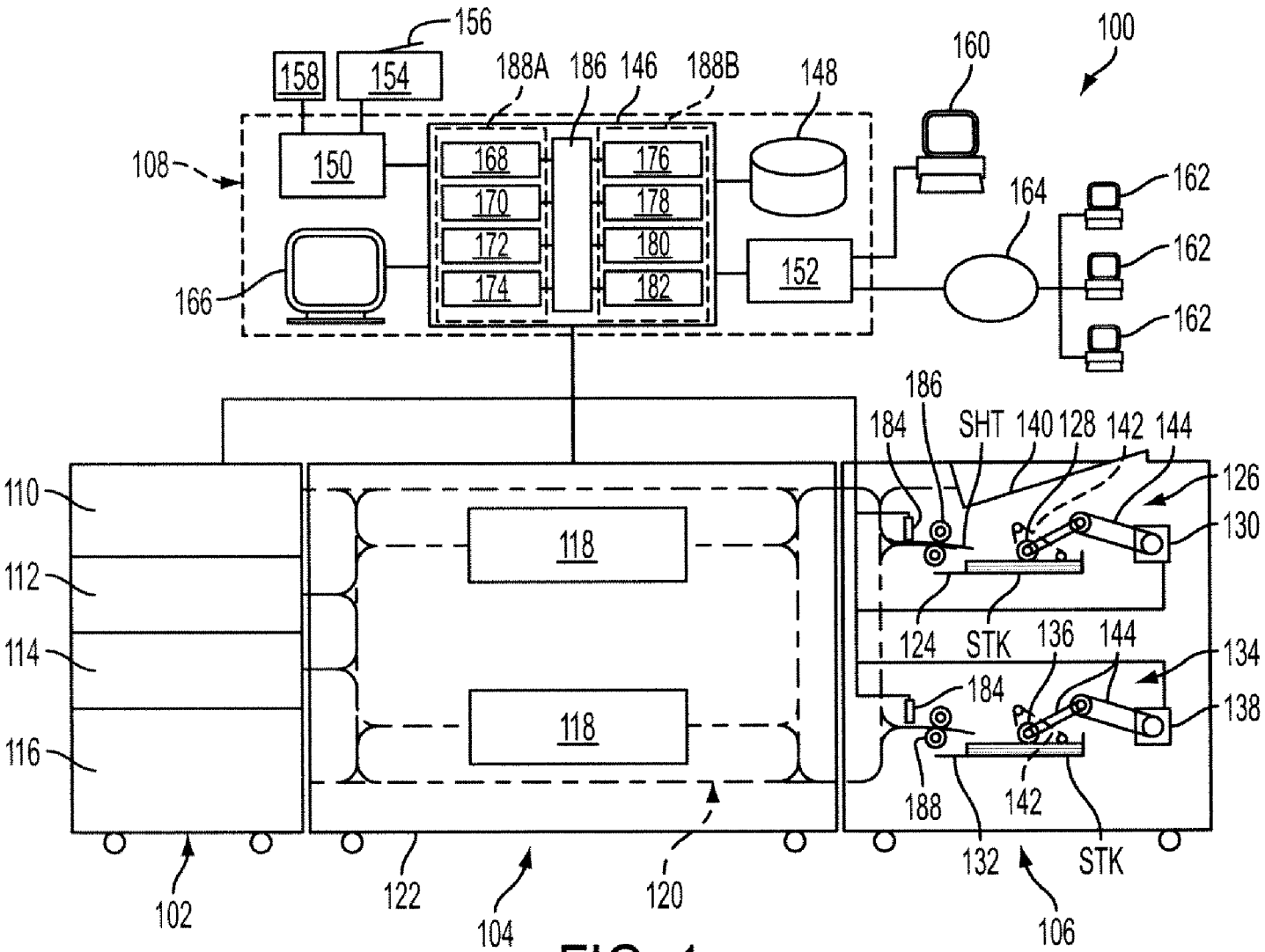
FIG. 1 is a schematic representation of an exemplary system that includes a compiling system capable of variable-speed operation.

Turning now to the drawings wherein the showings are for the purpose of illustrating exemplary embodiments, and not for limiting the same, FIG. 1 schematically illustrates a printing system 100 that includes a sheet media source 102, a marking system 104 in operative communication with the sheet media source, and a finishing unit 106 or other sheet media receiving system in operative communication with the sheet media source and/or marking system. Printing system 100 also includes a control system 108 in communication with one or more of the sheet media source, the marking system and the finishing unit for selective operation thereof. In the embodiment shown in FIG. 1, control system 108 is in communication with each of these systems. It is to be distinctly understood, however, that aspects of the present disclosure are applicable to a wide variety of types and kinds of printing systems, and that printing system 100 is merely exemplary of one suitable printing system.

Sheet media source 102 is shown in FIG. 1 as including multiple media supply trays 110, 112, 114 and 116, which are suitable for storing bulk quantities of sheet media. Sheet media source 102 can also optionally include a bypass supply tray (not shown) that is capable of handling smaller quantities of sheet media. It will be appreciated that the supply trays are operative to introduce individual sheets of media to a suitable sheet feeding system or mechanism for dispensing the individual sheets. Additionally, it will be appreciated that media supply trays 110-116 are capable of receiving and supporting quantities of sheet media of any one of a variety of different sizes (e.g., letter, legal, A4) and/or orientations (e.g., short-edge first, long-edge first) as well as sheet media of different types, kinds, materials or combinations of material, weights and/or thicknesses.

As shown in FIG. 1, marking system 104 can include one or more marking engines 118 (which may also be referred to herein as printing engines) in communication with media source 102 through a media transport pathway 120. It will be appreciated that the one or more printing engines can be of any suitable type or kind, and that such one or more printing engines will operate in accordance with known marking principles, such as ink jet marking or electrophotographic marking, for example. Marking system 104 includes a structural framework or housing structure 122 that is capable of supporting the one or more printing engines. Additionally, media transport pathway 120 extends through at least a portion of the structural framework to operatively communicate with the one or more printing engines.

With continued reference to FIG. 1, finishing unit 106 is shown as being in communication with the one or more printing engines of marking system 104 via media pathway 120. The finishing unit can be of any suitable type or kind, and can optionally be capable of performing one or more finishing operations of any type or kind. For example, the finishing unit can include any number of one or more collection trays for receiving sheets of media and can include any number of one or more compilers (which may also be referred to herein as compiling systems) for at least approximately aligning the sheets of media within a collection tray. Additionally, the finishing unit could, optionally, be operative to perform sorting, collating, stapling, hole punching, offsetting, binding, folding, separator sheet inserting or any combination of these and/or any other finishing operations.

In the exemplary arrangement shown in FIG. 1, finishing unit 106 includes a first collection tray 124 that is operatively associated with a variable-speed compiling system 126, which is adapted to engage and urge incoming sheets of media into approximate alignment with one or more registration surfaces (not numbered in FIG. 1) formed on or along the first collection tray. Variable-speed compiling system 126 includes a sheet-engaging element 128 for contacting the incoming sheets of media and a variable-speed drive unit 130 that is drivably connected to the sheet-engaging element.

Finishing unit 106 is also shown as including an optional second collection tray 132, which is shown as being used in operative association with a compiling system 134. In one preferred embodiment, compiling system 134 will also be a variable-speed compiling system that is substantially similar to compiling system 126. However, it will be appreciated that a compiling system of any suitable type and/or kind could alternately be used in association with the second collection tray. In the exemplary embodiment shown, compiling system 134 also includes a sheet-engaging element 136 and a variable-speed drive unit 138 that is drivably connected to the sheet-engaging element. Finishing unit 106 is shown as further including an optional third collection tray 140 that is of an uphill-type configuration and, as such, is not shown as being operatively associated with a compiling system or other component.

In FIG. 1, sheet-engaging elements 128 and 136 are shown as having a roller-type configuration that is frictionally engaging the topmost sheet of stacks STK of sheet media received in, on or along first and second collection trays 124 and 132. It will be appreciated, however, that any other suitable configuration, construction and/or arrangement of sheet-engaging element can alternately be used, such as one or more friction belts 142, for example. Additionally, it will be appreciated that drive units 130 and 138 can be drivably connected to the sheet-engaging elements in any suitable manner, such as by using one or more drive belts 144, for example.

Turning, now, to the general operation of a printing system in accordance with the present disclosure, such as printing system 100, for example, sheets of media are fed from a media source (e.g., sheet media source 102) to a printing engine (e.g., one of marking engines 118 of marking system 104) by way of a media pathway extending therebetween (e.g., media transport pathway 120). Once output by the marking engine or transported directly from the sheet media source, the sheet media (either marked or unmarked) is directed to a finishing unit or other sheet media receiving system (e.g., finishing unit 106). In some cases, the sheets of media may simply be output from the printing system, such through the use of collection tray 140, for example. Alternately, the sheets of media may be directed to a collection tray and compiler (e.g., collection tray 124 and compiling system 126) for one or more compiling operations (e.g., stacking, sorting and/or collating). Generally, such compiling operations will include at least approximately aligning an edge of the sheets of media with a registration surface of the corresponding collection tray. Optionally, one or more finishing operations may also be performed on the compiled sheets of media.

With more specific reference to the general operation of a variable-speed compiling system of the finishing unit, such as compiling system 126 and/or compiling system 134, for example, the sheet-engaging element (or elements) thereof is preferably operated at a first speed for accepting or otherwise initially engaging a sheet of media SHT (FIG. 1) received at the collection tray from along the associated transport pathway. This first speed of operation may, for example, result in a sheet-engaging surface of the sheet-engaging element traveling at a surface speed that is approximately equal to the linear speed of the incoming sheet of media (i.e., the sheet of media traveling into the collection tray from along the transport pathway). It will be appreciated that such approximately matched speeds might provide operational benefits, such as reduced wear due to slippage or scuffing, for example.

Returning to the general operation of the variable-speed compiling system, once the sheet of media has been engaged by the sheet-engaging element (or elements), the speed of operation of the sheet-engaging element is reduced to a second, lower speed, which results in the sheet-engaging surface having a corresponding second, lower speed. Due to the engagement of the sheet-engaging surface with the sheet of media, the linear speed of the same is also reduced to a lower rate of travel, such as a speed approximately equal to the surface speed of the sheet-engaging element, for example. As a result of the reduced rate of travel of the sheet of media, undesirable effects, such as element wear, sheet bounce-back and edge bending, for example, can be minimized or at least reduced.

As will be discussed in greater detail hereinafter, variation of the speed of operation of the sheet-engaging element can be accomplished in any suitable manner, such as by altering the output from a corresponding variable-speed rotation source (e.g., variable-speed drive 130 or 138), for example. Additionally, it will be appreciated that any such variation in the output characteristics of the variable-speed drive or rotational output source can be accomplished in any suitable manner. For example, a variable-speed drive could simply be operated at the first speed for a first period of time and the second speed for a second period of time. As other examples, a variable-speed drive could be operated with reference to one or more triggering events and/or signals, or with respect to a combination of timing and triggering events. Additionally, the variation in the speed of operation of a variable-speed drive can, optionally, follow a predetermined speed profile over which the speed of operation is altered according to predetermined data, inputs and/or conditions, such as at predetermined rates of change and/or for predetermined durations, for example. Furthermore, the variation of the speed of operation can, optionally, be selectively varied based on any suitable factors and/or conditions, such as due to variations in printing system performance and/or variations in sheet media characteristics, for example.

A suitable control system, such as control system 108, for example, can be utilized to operate the foregoing and other systems and/or components of the printing system, such as in the manner discussed above, for example. As shown in FIG. 1, control system 108 includes a controller 146 in communication with sheet media source 102, marking system 104 and finishing unit 106, each in a suitable manner. As one example, media source 102, marking system 104 and finishing unit 106 could be under direct supervision and control by controller 146, as is illustrated in FIG. 1. Alternately, control system 108 could optionally include one or more electronic control units that are respectively associated with the sheet media source, the marking system and the finishing unit. Such one or more ECUs, if provided, can be in communication with the controller and at least partially supervise and/or control the respective components and/or systems with which the ECU or ECUs are associated.

Control system 108 can optionally include a data storage device 148, such as a non-volatile memory or hard drive, for example, that is suitable for storing print jobs, settings, attributes and any other data, values, text, graphics, information and/or content. The data storage device is shown in FIG. 1 as being in direct communication with controller 146, though it will be appreciated that any other suitable arrangement could alternately be used. Additionally, control system 108 can optionally include an input interface 150 and/or a communication interface 152, both of which are shown as being in communication with controller 146.

Either or both of input interface 150 and communication interface 152 can be used to communicate, generate, receive, input or otherwise provide print jobs to the printing system. For example, input interface 150 can be in communication with an optional raster output scanning system 154 suitable for scanning paper documents and transmitting rasterized images of the scanned documents in the form of image data to the controller or another system or component. Scanning system 154 can optionally include an automatic document feeding device 156 or other suitable arrangement for inputting sheet media. As another example, input interface 150 could be in communication with an optional memory device reader 158 adapted to retrieve document files, image files or other data or information from portable memory devices, such as memory cards, for example, and transmit such files, data or information to controller 146 or another system or component.

As a further example, a print job could optionally be transferred or otherwise sent to the printing system through communication interface 152, such as from a standalone computer 160 and/or from a computer workstation or terminal 162, for example, by way of any suitable line of communication, such as through a computer network 164, for example. A print job, however transmitted or received, can be directly communicated to controller 146 for processing or the print job can be stored in a suitable manner, such as within data storage device 148, for example, until recalled for printing.

One or more user interface devices, such as a display, keyboard, pointing device, indicator lamp, associated computing device (e.g., a remotely connected or networked computer) or other input or output device, for example, is provided on printing system 100 and is in communication with controller 146. In one preferred embodiment, a display 166 is provided that outputs graphical programming windows for communication of text, graphics, data, values and/or information to a user or operator. Additionally, the user interface is adapted for user input of text, graphics, data, values and/or information, such as from the keyboard (not shown), pointing device (not shown) or, in one preferred embodiment, touch-screen input on display 166, for example. It will be appreciated, however, that the foregoing user interface arrangement is merely exemplary and that text, graphics, data, values and/or information can be inputted and outputted in any suitable manner.

Control system 108, as is shown in FIG. 1, can optionally include a print job-receiving module 168 that is capable of receiving, processing, storing and/or otherwise transferring data, information, signals and/or communications relating to a print job communicated to printing system 100, such as by way of input interface 150 and/or communication interface 152, for example. As one example, a print job could be received by way of communication interface 152 and include image data, which is represented in FIG. 1 by box 170, representing or otherwise having a relation to the markings to be generated on one or more of sheets of media. Such a print job may also include sheet media data, which is represented in FIG. 1 by box 172, representing or otherwise having a relation to print job characteristics, such as the size and type of sheet media to be used for the print job, the number of reproductions of the document to be generated and/or the desired finishing operations to be performed, for example. Print job-receiving module 168 is preferably capable of receiving, processing, storing and/or communicating such image and sheet media data to one or more other systems and/or components of printing system 100.

As previously discussed, control system 108 is operative to selectively vary the operating speed of a compiling system (e.g., compiling systems 126 and 134) of printing system 100 such that the sheet-engaging element thereof (e.g., sheet-engaging element 128, 136 and/or 142) operates at a first speed prior to engaging an incoming sheet of media (e.g., sheet SHT in FIG. 1) and at a second, lower speed after engaging that incoming sheet of media but prior to the same contacting a registration surface of a corresponding collection tray (e.g., collection trays 124 and 132). It will be appreciated that such variation in speed of operation can be effected, controlled and/or otherwise implemented in any suitable manner. For example, control system 108 is shown in FIG. 1 as including an operating module 174 that is capable of sending, receiving, generating and/or otherwise communicating data, information, signals and/or instructions having a relation to the operating speed of a compiling system, such as compiling systems 126 and 134, for example.

Operating module 174 can utilize any suitable data, values, settings, parameters, inputs, signals, algorithms, routines and/or any other information or content for controlling the variation in operating speeds of a compiling system. For example, control system 108 could include predetermined speed data and/or values, which are collectively represented in FIG. 1 by box 176, that are utilized by operating module 174 to selectively increase and/or decrease the operating speed of one or more compiling systems. As another example, control system 108 could include one or more algorithms or other formulas and/or calculations, which are represented in FIG. 1 by box 178, for use in selectively increasing and/or decreasing the operating speed of one or more compiling systems.

Control system 108 can also optionally include a selection module 180 that is capable of selecting between different first speeds, different second speeds, different rates of change, different durations and/or different ones of any other such operating characteristics. For example, it may be desirable to select different first speeds and different second speeds depending upon the sheet media data (e.g., box 172) corresponding to a given print job so that faster or slower speeds can be used depending upon the size and/or thickness of sheet media that is called for by the print job.

Control system 108 can also optionally include a timing module 182 that is capable performing any desired timing operations, such as determining the time period between two event-related signals or communicating a timing signal at a predetermined period of time after receiving an event-related signal, for example. As a more specific example, it may be desirable for operating module 174 to decelerate a sheet-engaging element (e.g., element 128) of a compiling system (e.g., compiling system 126) at a predetermined time after the arrival of a sheet of media (e.g., sheet SHT) at a predetermined location. It will be appreciated that such arrival may be monitored or otherwise determined in any suitable manner, such as by using a sheet-arrival sensor 184 that is operatively associated with a portion of the media transport pathway (e.g., pathway 120), for example. Upon receiving a sheet-arrival signal from sensor 184, timing module 182 can perform a timing operation for generating or otherwise communicating a suitable timing signal to operating module 174 after predetermined period of time, such as a time slightly greater than the expected duration for the sheet of media to arrive at and be engaged by the sheet-engaging element, for example.

A control system, such as control system 108, for example, will include a processing device, which can be of any suitable type, kind and/or configuration, such as a microprocessor, for example, for processing data, executing software routines/programs, and other functions relating to the performance and/or operation of the printing system (e.g., printing system 100). Additionally, the control system (e.g., control system 108) will include a storage device or memory, which can be of any suitable type, kind and/or configuration that can be used to store data, values, settings, parameters, inputs, software, algorithms, routines, programs and/or other information or content for any associated use or function, such as use in association with the performance and/or operation of the printing system or communication with a user or operator, for example.

In the embodiment shown in FIG. 1, controller 146 includes a microprocessor 186 and a storage device or memory, which is represented in FIG. 1 by boxes 188A and 188B. In the embodiment shown, modules 168, 174, 180 and 182 are implemented as software stored within memory 188A and 188B. Thus, microprocessor 186 can access memory stores 188A and 188B to retrieve and execute any one or more software modules, such as modules 168, 174, 180 and/or 182, for example. Additionally, data, values, settings, parameters, inputs, software, algorithms, routines, programs and/or other information or content, such as data 170, 172 and 176 and algorithms 178, for example, can also be retained within memory 188A and 188B for retrieval by microprocessor 186. It will be appreciated that such software routines can be individually executable routines or portions of a software program, such as an operating system, for example. Additionally, it will be appreciated that the control system, including any controller, processing device and/or memory, can take any suitable form, configuration and/or arrangement, and that the embodiments shown and described herein are merely exemplary. Furthermore, it is to be understood, however, that the modules described above in detail can be implemented in any suitable manner, including, without limitation, software implementations, hardware implementations or any combination thereof.

Printing systems commonly include one or more sheet media sensors capable of generating a signal indicative of the presence or absence of a sheet of media within a predetermined proximity of the sensor. For purposes of clarity and ease of illustration, only sheet media sensor 184 is shown and specifically referred to herein. It is to be understood, however, that any suitable number and/or arrangement of sheet media sensors can be used, Additionally, printing systems commonly include a plurality of nips, rollers and other elements disposed along the media transport pathway for urging the sheets of media therealong. However, for purposes of clarity and ease of understanding, only nip rollers 186 and 188 are shown and specifically referred to herein. Nip rollers 186 and 188 are shown as being operatively disposed along transport pathway 120 adjacent compiling systems 126 and 134, respectively, and operate to deliver sheets of media (e.g., sheet SHT) into a corresponding one of the collection trays for engagement by the sheet-engaging element (e.g., 128, 136 and/or 142) operatively associated therewith.

FIGS. 2-5 illustrate a variable-speed compiling system in accordance with the present disclosure in greater detail. In this case, specific reference is being made to collection tray 124 and variable-speed compiling system 126 of finishing unit 106. However, it is to be understood that such specific reference is merely exemplary and that such additional details may be equally applicable to any other suitable collection trays and/or compiling systems.

Figure 5:
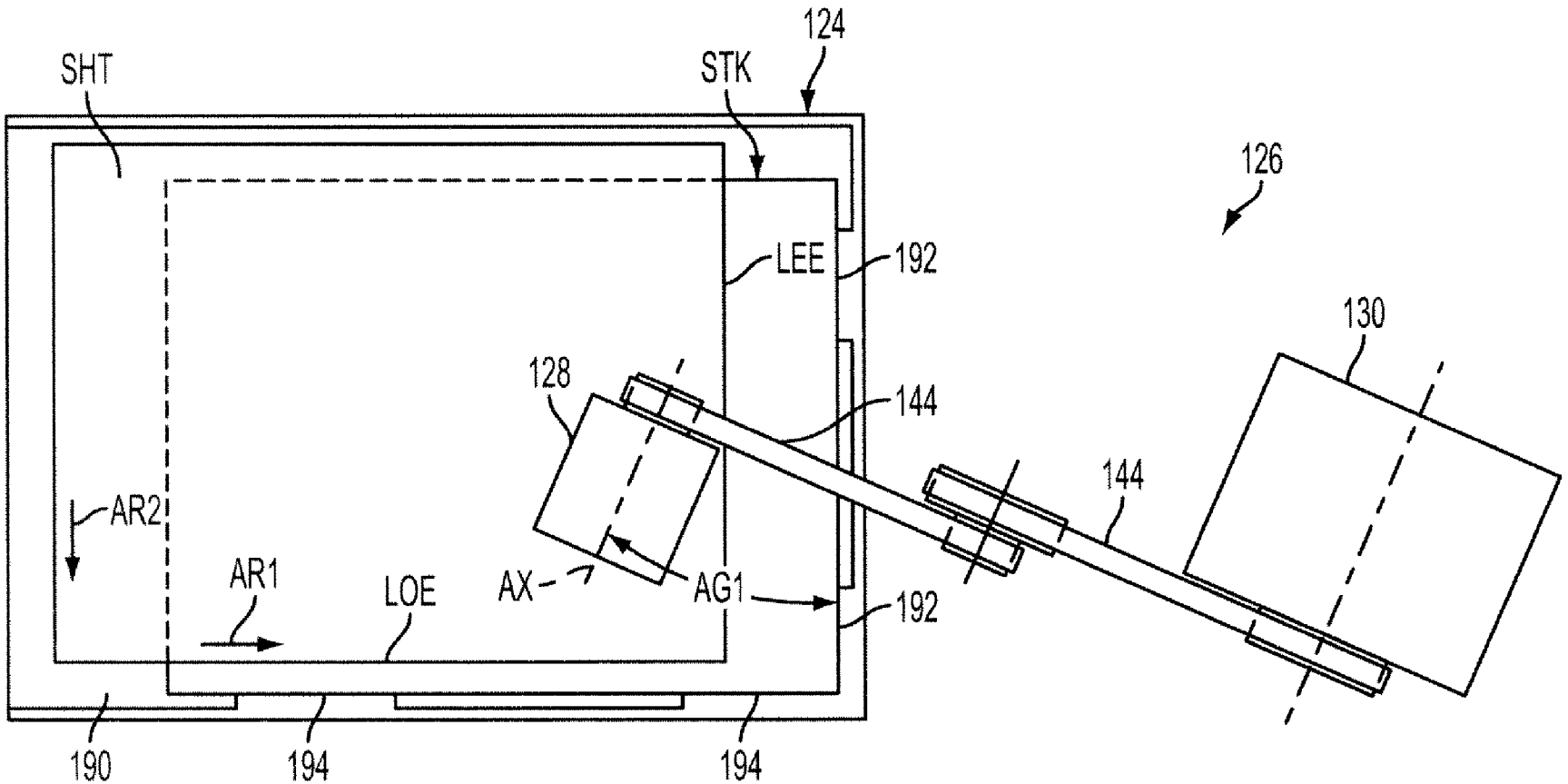
FIG. 5 illustrates the sheet of media entering the collection tray of FIGS. 2-4 and being influenced by the compiling system as viewed from line 5-5 of FIG. 2.

Collection tray 124 is shown in FIGS. 2-5 as including a bottom wall 190. Additionally, a first or primary registration wall or surface 192 and a second or secondary registration wall or surface 194 project from the bottom wall in approximately transverse relation thereto. It will be recognized that the sheets of media can be at least approximately aligned with either one or both of registrations surfaces 192 and 194, which are shown as being disposed approximately transverse to one another. As shown in FIG. 5, compiling system 126 is capable of urging incoming sheet of media SHT into at least approximate alignment with both first registration surface 192 and second registration surface 194, as is indicated by arrows AR1 and AR2. This can be accomplished in any suitable manner, such as by disposing an axis AX of sheet-engaging element 128 of compiling system 126 at an angle AG1 relative to the collection tray, for example. It will be appreciated that such an angle can be formed in relation to any suitable feature of the collection tray, such as one of registration walls 192 and 194, for example. Additionally, it will be appreciated that such an angle can be of any suitable value, such as within a range of from about 5 degrees to about 85 degrees, for example.

Figure 6:
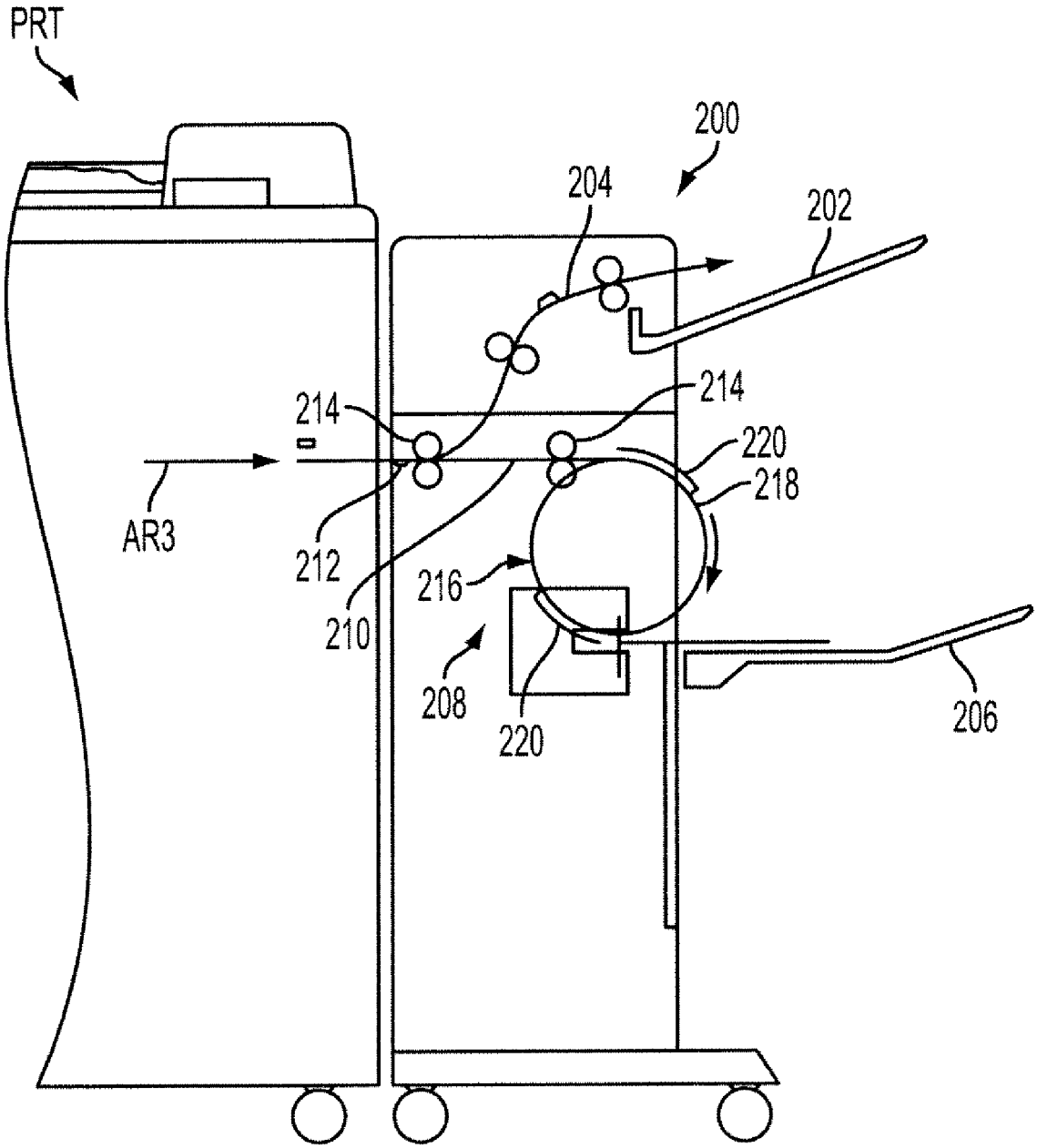
FIG. 6 illustrates another example of a compiling system in use registering a sheet of media within a collection tray of a finishing unit.

FIG. 6 illustrates another exemplary embodiment of a finishing unit 200 shown in operative communication with an associated printing system PRT, such as printing system 100, for example. Finishing unit 200 includes a first collection tray 202, which is shown as being of a conventional uphill type configuration, that is operatively associated with a portion 204 of a media transport pathway. Finishing unit 200 also includes a second collection tray 206 and a variable-speed compiling system 208 that is operatively associated with the second collection tray. Compiling system 208 is operatively disposed along another portion 210 of the media transport pathway and receives sheets of media therefrom, as is represented by arrow AR3, for compiling in, on or along the second collection tray. A sheet sensor 212 can optionally be included along the media transport pathway, such as has been discussed above with regard to printing system 100, for example. Additionally, suitable transport elements and/or components, such as nip rollers 214, for example, can be operatively disposed along the transport pathway in a conventional manner.

Compiling system 208 differs from the previously described compiling systems (e.g., compilers 126 and 134) in that compiling system 208 includes a friction disk 216, which may also be referred to in the art as a disk stacker, as the sheet-engaging element, rather than a roller or belt type sheet-engaging element, such as is illustrated in FIG. 1, for example. Typically, friction disks include a disk body 218 and one or more flaps or other elements 220 that are attached to or otherwise secured along the disk body. In use, an incoming sheet of media will be received in the space or gap (not numbered) between the disk body and one of the flaps. The motion of the friction disk, as is represented by arrow AR4, causes the sheet of media to be frictionally engaged between the disk body and the flap. Thus, the sheet of media can be urged into at least approximate alignment with a suitable registration wall or surface (not numbered), such as may be associated with the finishing unit or the compiling tray, for example.

Friction disk 216 differs from other known friction disk compiling systems in that friction disk 216 is driven by a variable-speed drive unit (not shown). As such, the friction disk can be operated to rotate at a first angular speed for engaging the incoming sheet of media and then operate at a second, lower angular speed for at least approximately aligning the sheet of media with the associated registration wall or surface, such as, for example, in one of the manners described herein. It will be appreciated that any suitable variable-speed drive unit can be used and that such a variable-speed drive unit can be drivably interconnected with the friction disk in any suitable manner.

With reference, now, to FIGS. 2-4 and 7, one example of the operation and use of a variable-speed compiling system is shown. Specific reference will be made to collection tray 124 and variable-speed compiling system 126 in describing this exemplary operation and use. However, it is to be recognized that any other suitable collection tray (e.g., collection tray 206) and/or variable-speed compiling system (e.g., variable-speed compiling system 208) could alternately be used.

Figure 2:
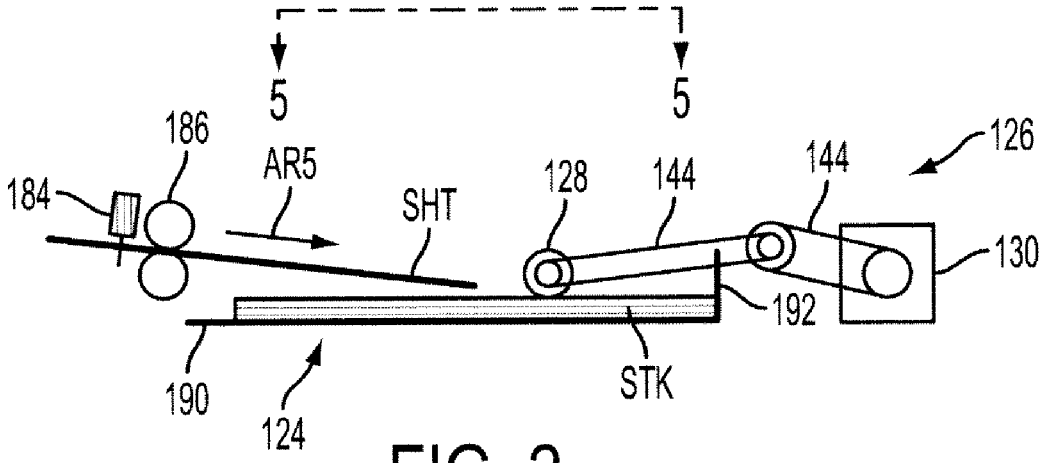
FIGS. 2-4 illustrate a series of side views of one example of a compiling system in use during registration of a sheet of media within a collection tray of a finishing unit.

In FIG. 2, an incoming sheet of media SHT is shown as being fed or otherwise delivered into collection tray 124 and toward sheet-engaging element 128 of variable-speed compiling system 126. Incoming sheet of media SHT is traveling along a portion of the transport pathway of the printing system at a first sheet speed, as is represented by arrow AR5. In one exemplary case, sheet-engaging element 128 is operated (e.g., rotated or otherwise driven) at a first speed, which is represented by line segment FSP of speed profile SPF in FIG. 7. The first speed of operation of the sheet-engaging element will preferably have at least some relation to the speed of the incoming sheet of media, such as being within a range of approximately 75 percent to approximately 125 percent of the first sheet speed, for example. It will be appreciated that any suitable measure can be used to determine or otherwise establish first speed FSP. For example, first speed FSP could be considered the linear surface speed of the sheet-engaging surface of sheet-engaging element 128. In one, more specific, example, sheet-engaging element 128 can be operated such that the sheet-engaging surface thereof is traveling at a first surface speed that is approximately equal to the first sheet speed of the incoming sheet of media (e.g., within a range of from about 90 percent to about 110 percent of the first sheet speed).

Figure 7:
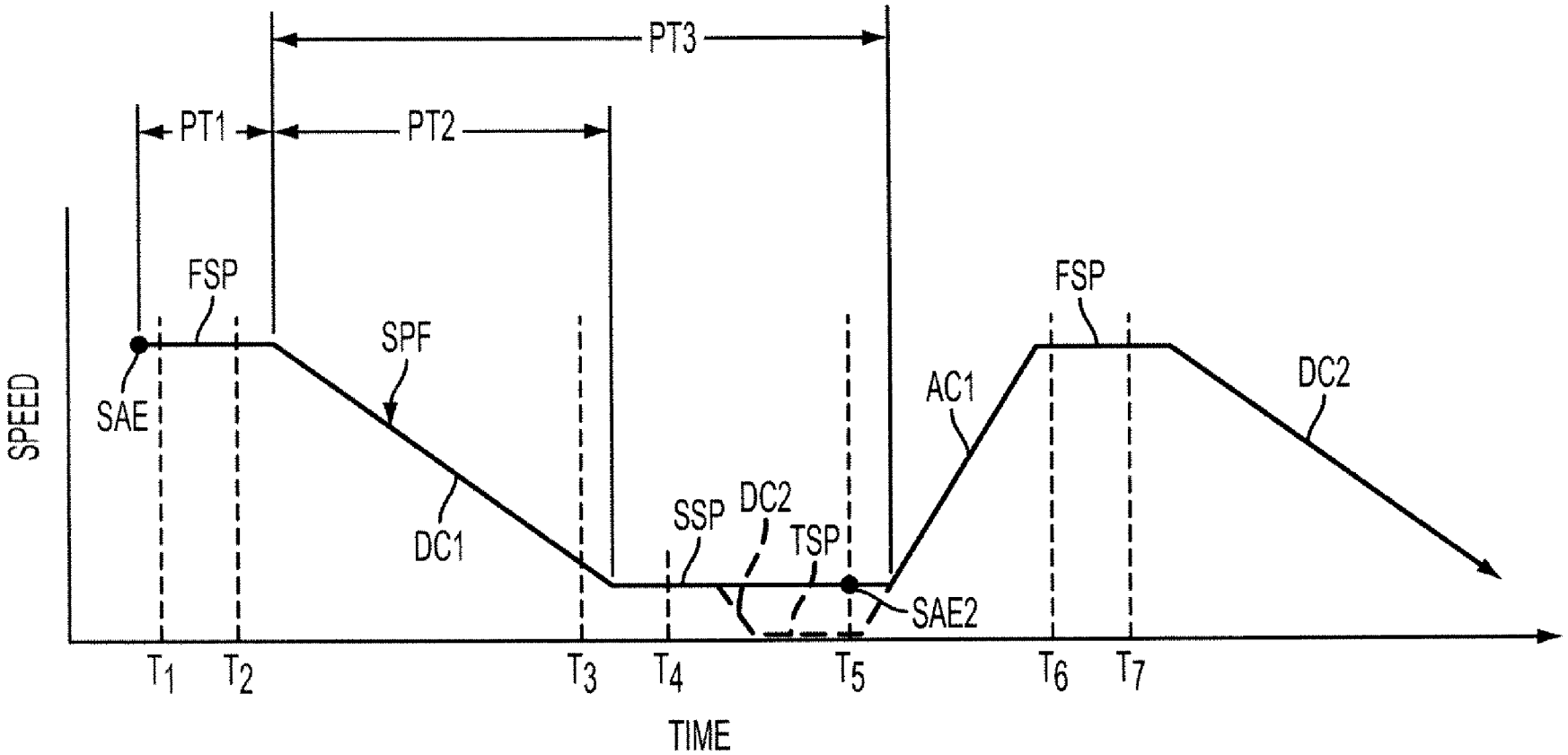
FIG. 7 illustrates one example of a drive-velocity profile for a compiling system.

It will be recognized that, in FIG. 2, incoming sheet of media SHT has not yet reached variable-speed compiling system 126. Thus, sheet-engaging element thereof has not yet engaged or otherwise contacted the incoming sheet of media. This condition is represented in FIG. 7 as occurring at time $T_1$. Shortly thereafter (depending upon the speed of travel of the incoming sheet of media), sheet-engaging element 128 contacts or otherwise engages the incoming sheet of media. In one preferred example of operation, such initial engagement can occur with the sheet-engaging surface of the sheet-engaging element operating at approximately the same speed (e.g., where the first surface speed is within a range of from about 90 percent to about 110 percent of the first sheet speed). This initial engagement condition is represented by time $T_2$ in FIG. 7. First surface speed FSP is shown in FIG. 7 as being substantially constant before and after the initial engagement occurs at time $T_2$. However, it will be appreciated that in actual operation some minor variations in speed may occur at such time, but that such minor variations are not shown in FIG. 7.

Figure 3:
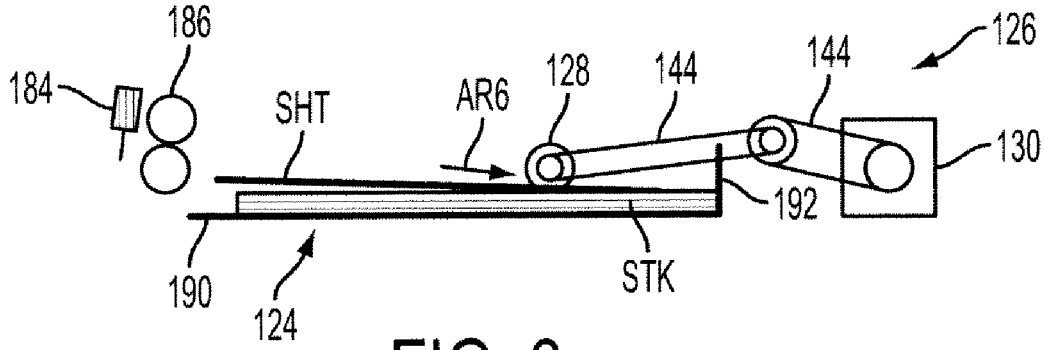
Figure 4:
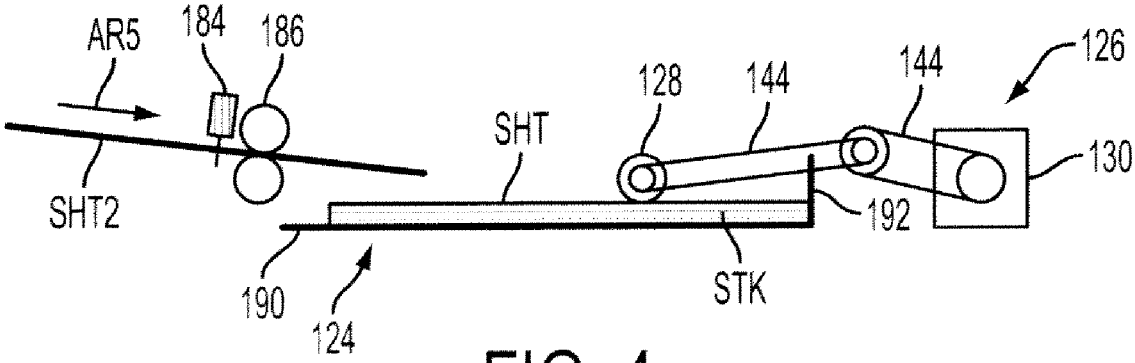

In FIG. 3, incoming sheet of media SHT is shown as being disposed overtop or otherwise along the topmost sheet of stack STK and engaged (e.g., frictionally contacted) by sheet-engaging element 128. However, incoming sheet of media SHT has not yet reached or otherwise contacted a registration wall or surface, such as registration wall 192, for example. This condition is represented by time T3 in FIG. 7. Additionally, speed profile SPF indicates that the sheet-engaging element of the variable-speed compiling system is decelerating from first surface speed FSP to a second surface speed SSP, as is indicated by line segment DC1 in FIG. 7. It will be appreciated that such deceleration of the sheet-engaging element will result in a corresponding reduction in the speed of travel of the incoming sheet of media, such as is represented in FIG. 3 by shorter arrow AR6. Such deceleration can be accomplished in any suitable manner and at any suitable rate of change or otherwise over any suitable duration. As such, second surface speed SSP can be less than first surface speed FSP by any suitable amount, such as a speed that is within a range of from about 5 percent to about 95 percent of the first surface speed, for example. Also, it will be appreciated that such rate of change and/or duration may vary depending upon any one of a variety of factors, such as such as sheet speed, sheet size and/or type of media, for example.

Additionally, it will be appreciated that such deceleration can occur at any suitable point in time. For example, it will be appreciated that at a time prior to the arrival of the incoming sheet of media at the collection tray, the position of incoming sheet of media may be sensed by a suitable sheet sensing device (e.g., sheet media sensor 184), as is represented by sheet arrival event SAE in FIG. 7. At a predetermined period of time PT1 after the incoming sheet of media is sensed (e.g., at sheet arrival event SAE), the action of decelerating the sheet-engaging element can occur. It will be appreciated that any suitable period of time may be used, such as from about 10 milliseconds to about 100 milliseconds, for example, depending upon any one or more of a variety of factors, such as sheet speed, sheet size, position of sensor and/or type of media, for example. Further, it will be appreciated that such predetermined period of time can be selectively varied from one operation to the next, such as by control system 108, for example, depending on any one or more of such factors.

Furthermore, it will be appreciated that such deceleration can be completed at any suitable point in time. For example, the deceleration of the sheet-engaging surface of the sheet-engaging element from first surface speed FSP to second surface speed SSP can occur over a predetermined period of time PT2, as illustrated in FIG. 7. Additionally, or in the alternative, the rate of change can be based, in whole or in part, on any one or more of a variety of factors, such as sheet speed, sheet size, position of sensor and/or type of media, for example.

In whichever manner achieved, the sheet-engaging surface of the sheet-engaging element can, in one exemplary embodiment, be reduced to at least approximately second surface speed SSP prior to an edge (e.g., a leading edge LEE or a longitudinal edge LOE in FIG. 5) initially contacting or otherwise arriving at an associated registration wall or surface (e.g., surface 192 and/or 194), which initial contact event is represented by time $T_4$ in FIG. 7. The variable-speed compiling system can continue to operate the sheet-engaging element at second surface speed SSP until such time as the sheet-engaging element is accelerated, once again, to greater speed of operation, such as first surface speed FSP, for example, as is represented in FIG. 7 by line segment AC1. Optionally, the sheet-engaging element of the variable-speed compiling system can be further decelerated from second surface speed SSP to a third surface speed TSP, as is indicated by line segment DC2 in FIG. 7. Such further deceleration may be useful in reducing wear and/or other undesirable conditions from occurring due to the continued dynamic contact between the sheet-engaging surface of the sheet-engaging element and the now-stationary sheet of media (i.e., incoming sheet of media SHT). It will be appreciated that, if included, any suitable speed of operation can be used for third surface speed TSP, such as from a speed in a range of from about zero (i.e., a stationary sheet-engaging element) to about second surface speed SSP, for example.

It will be appreciated that the sheet-engaging element can be accelerated back to a greater speed of operation, such as first surface speed FSP, for example, at any suitable point in time prior to contact thereof with a second incoming sheet of media SHT2, as is illustrated in FIG. 5. In FIG. 7, the condition illustrated in FIG. 5 is represented as time $T_6$ and the contact or engagement of the sheet-engaging element with the second incoming sheet of media is indicated by time $T_7$. Thereafter, the same speed profile (e.g., speed profile SPF) can be continued or a different speed variation profile initiated or otherwise performed, such as is indicated by deceleration line segment DC2, for example. As one example of such a suitable point in time, the sheet-engaging element of the variable-speed compiling system could be accelerated from second surface speed SSP (or optionally from third surface speed TSP) to a greater speed of operation, such as first speed of operation FSP, for example, at a predetermined period of time PT3 after the initial deceleration event. It will be appreciated, however, that any other period of time (e.g., a predetermined duration beginning at the end of period PT2) could alternately be used. As another example, the sheet-engaging element can be accelerated back to a greater speed of operation, such as first surface speed FSP, for example, after the position of the second incoming sheet of media is sensed by a suitable sheet sensing device (e.g., sheet media sensor 184), as is represented by sheet arrival event SAE2 at time $T_5$ in FIG. 7.

Figure 8:
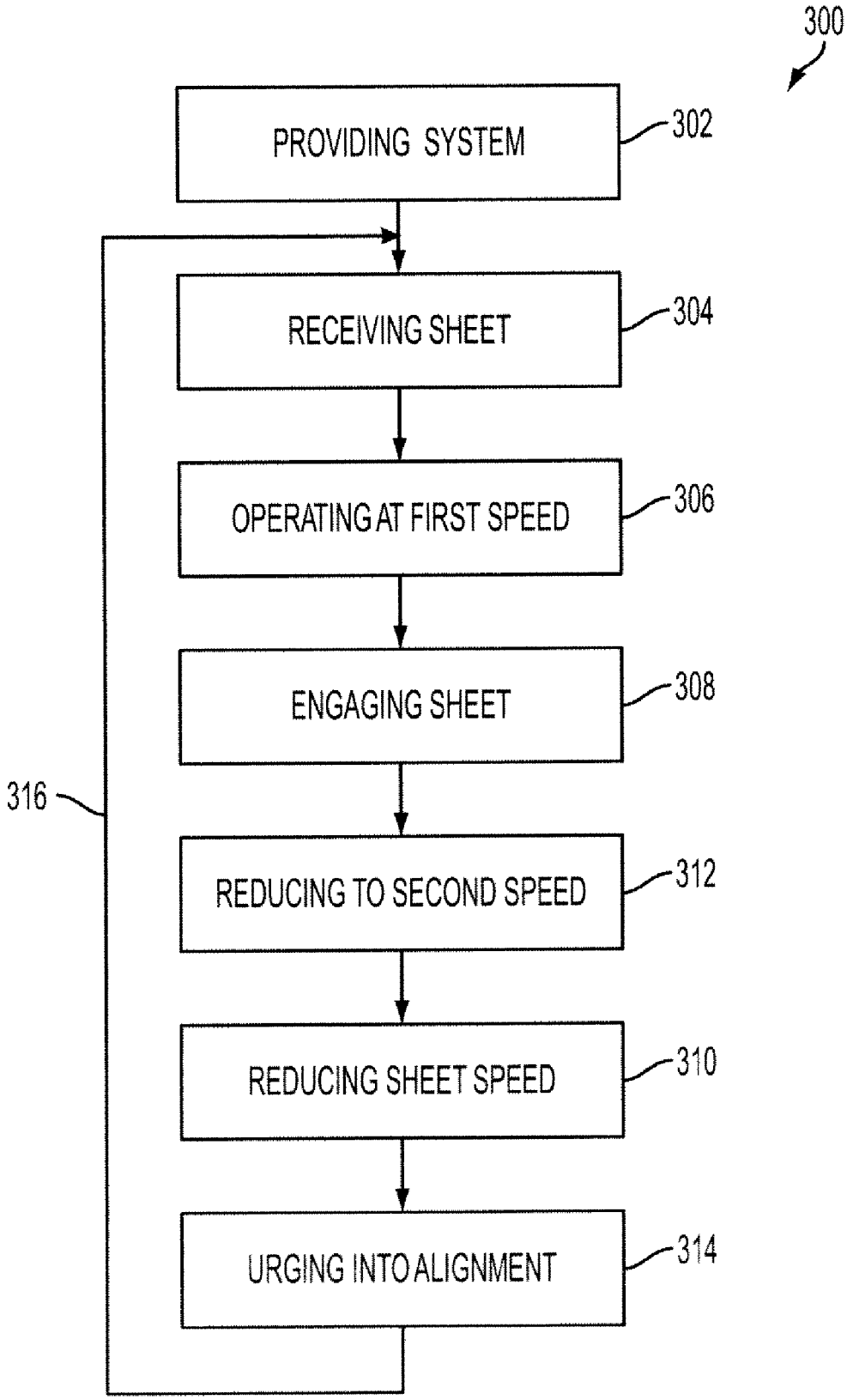
FIG. 8 is a diagrammatic representation of one method of operating a variable-speed compiling system of a finishing unit of a printing system to compile sheets of media.

Turning, now, to FIG. 8, one exemplary method 300 of compiling sheet media is shown that includes providing a compiling system adapted to permit variable speed operation of a sheet-engaging element thereof, such as sheet-engaging element 128 of compiling system 126 in printing system 100, for example, as is indicated by box 302 in FIG. 8. Method 300 also includes receiving an incoming sheet of media (e.g., sheet of media SHT) at or along the compiling system (e.g., compiling systems 126 and 208 respectively of finishing units 106 and 200), as is indicated by box 304 in FIG. 8. Method 300 further includes operating a variable-speed compiling system (e.g., compiling systems 126 and 208) at a first speed suitable for engaging the incoming sheet of media traveling at a first sheet speed, as indicated by box 306.

Method 300 also includes engaging the incoming sheet of media using the variable-speed compiling system while the sheet of media is traveling at the first sheet speed and the compiling system is operating at the first speed of operation, as is indicated by box 308. Method 300 further includes reducing the speed of travel of the incoming sheet of media to a second, lower sheet speed, as is represented by box 310 in FIG. 8. It will be appreciated that such a reduction in sheet speed can be accomplished in any suitable manner, such as by reducing the speed of operation of the sheet-engaging element of the variable-speed compiling system to a second, lower speed, as is indicated by box 312. Regardless of the manner in which the speed of travel of the incoming sheet of media is reduced, method 300 also includes urging the incoming sheet of media into at least approximate alignment with a suitable registration surface or wall using the variable-speed compiling system, as is represented by box 314 in FIG. 8.

It will be appreciated that a method of operation in accordance with the subject matter of the present disclosure, such as method 300, for example, can be repeated for any desired number of incoming sheets of media, as indicated by arrow 316. Additionally, it will be appreciated that any other actions, operations and/or steps can optionally be included, such as an action decelerating the sheet-engaging element to a third surface speed (e.g., speed TSP in FIG. 7) and/or an action of selecting one or more different periods of time, deceleration rates and/or speeds of operation depending on a property or characteristic of the incoming sheet of media, for example.

Furthermore, it will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a sheet media source adapted to selectively dispense sheet media;

at least one printing engine in operative communication with said sheet media source for receiving sheet media therefrom, said at least one printing engine adapted to output marked sheet media;

a finishing unit disposed in operative communication with said at least one printing engine for receiving marked sheet media therefrom such that the marked sheet media will have a direction of travel, a leading edge, a trailing edge and a longitudinal edge extending therebetween, said finishing unit including a collection tray and a variable-speed compiling system, said collection tray including a first registration surface disposed approximately transverse to said direction of travel, said collection tray adapted to receive the marked sheet media such that the leading edge thereof will be disposed toward said first registration surface, said variable-speed compiling system including a sheet-engaging element having an axis and a sheet-engaging surface operative to frictionally engage a sheet of marked sheet media, said variable-speed compiling system operative to displace said sheet-engaging surface about said axis at at least a first speed and a second speed that is less than said first speed; and, a control system in communication with said sheet media source, said at least one printing engine and said finishing unit, said control system operative to:

determine arrival of a sheet of marked sheet media at said finishing unit;

operate said variable-speed compiling system such that said sheet-engaging surface is displaced about said axis at said first speed prior to said sheet-engaging surface of said sheet-engaging element frictionally engaging the sheet of marked sheet media and after frictionally engaging the sheet of marked sheet media;

operate said variable-speed compiling system such that said sheet-engaging surface is displaced about said axis at said second speed after frictionally engaging the sheet of marked sheet media and thereby decelerating the sheet of marked sheet media during movement in said direction of travel prior to the leading edge of the sheet of marked sheet media contacting said first registration surface; and, operate said variable-speed compiling system to at least approximately align the leading edge of the sheet of marked sheet media with said first registration surface.

2. A printing system according to claim 1, wherein said control system includes a processor and a memory, said memory storing a speed profile having a relation to at least said first and second speeds, said processor operative to generate a control signal corresponding to said speed profile, and said control system adapted to communicate said control signal to said variable-speed compiling system for operation thereof at at least said first and second speeds.

3. A printing system according to claim 2, wherein said speed profile is one of a plurality of speed profiles stored in said memory, and said processor is adapted to select one of said plurality of speed profiles and generate a control signal corresponding to said selected one of said plurality of speed profiles for communication to said variable-speed compiling system.

4. A printing system according to claim 3, wherein said control system includes a print job-receiving module adapted to receive at least sheet media data corresponding to an associated print job with said controller selecting one of said plurality of speed profiles based at least in part on said sheet media data.

5. A printing system according to claim 4, wherein said sheet media data includes data corresponding to at least one of media size, media weight and media material, and said controller is operative to select said one of said plurality of speed profiles based at least in part on said data corresponding to at least one of media size, media weight and media material.

6. A printing system according to claim 1, wherein said control system is operative to maintain said variable-speed compiling system at approximately said second speed at least until the leading edge of the sheet of marked sheet media is at least approximately aligned with said first registration surface.

7. A printing system according to claim 6, wherein said control system is operative to operate said variable-speed compiling system at a third speed after at least approximately aligning the leading edge of the sheet of marked sheet media with said first registration surface.

8. A printing system according to claim 1, wherein said control system is adapted to generate control signals for operating said variable-speed compiling system at said first and second speeds, and said variable-speed compiling system includes a rotational output device drivably connected to said sheet-engaging element, said rotational output device in communication with said control system and adapted to receive said control signals therefrom for generating rotational output corresponding to at least said first and second speeds.

9. A printing system according to claim 8, wherein said sheet-engaging element includes one of a rotating wheel having an outer frictional surface operative as said sheet-engaging surface, a rotating cylinder having an outer frictional surface operative as said sheet-engaging surface, an endless belt having an outer frictional surface operative as said sheet-engaging surface and a rotating disk having at least one sheet-receiving slot operative as said sheet-engaging surface.

10. A printing system according to claim 1, wherein said collection tray includes a second registration surface disposed transverse to said first registration surface and in approximate alignment with said direction of travel, and said variable-speed compiling system is operative to approximately align the longitudinal edge of the sheet of marked sheet media with said second registration surface.

11. A printing system according to claim 10, wherein said variable-speed compiling system is operative to approximately align the longitudinal edge of the sheet of marked sheet media with the second registration surface while operating at said second speed and while maintaining frictional engagement with the sheet of marked sheet media.

12. A printing system comprising:

a sheet media source adapted to selectively dispense sheet media;

at least one printing engine in operative communication with said sheet media source and adapted to receive sheet media therefrom, said at least one printing engine being adapted to output marked sheet media;

a media transport pathway disposed in operative communication with said sheet media source and said at least one printing engine, said media transport pathway adapted to transport sheet media from said sheet media source to said at least one printing engine and to transport sheet media away from said at least one printing engine in a direction of travel such that the sheet media has a leading edge, a trailing edge and at least one longitudinal edge extending therebetween;

a finishing unit disposed in operative communication with said media transport pathway and adapted to receive sheet media from said media transport pathway, said finishing unit including a collection tray and a variable-speed compiling system, said collection tray including a first registration surface disposed approximately transverse to said direction of travel, said collection tray adapted to receive sheet media such that the leading edge thereof will be disposed toward said first registration surface, said variable-speed compiling system including a sheet-engaging element having an axis and a sheet-engaging surface operative to frictionally engage a sheet of the sheet media entering said collection tray, said variable-speed compiling system operative to displace said sheet-engaging surface about said axis at a first speed and a second speed that is less than said first speed; and, a control system in communication with at least said finishing unit, said control system adapted to:

determine arrival of a sheet of the sheet media at said collection tray;

operate said variable-speed compiling system such that said sheet-engaging surface is displaced about said axis at said first speed prior to frictionally engaging the sheet as well as after frictionally engaging the sheet;

operate said variable-speed compiling system such that said sheet-engaging surface is displaced about said axis at said second speed after frictionally engaging the sheet and thereby decelerate the sheet prior to the leading edge of the sheet contacting said first registration surface; and, operate said variable-speed compiling system such that said sheet-engaging surface is displaced about said axis to at least approximately align the leading edge of the sheet with said first registration surface.

13. A printing system according to claim 12, wherein said control system includes a processor and a memory, said memory storing a speed profile having a relation to at least said first and second speeds, said processor operative to generate a control signal corresponding to said speed profile, and said control system adapted to communicate said control signal to said variable-speed compiling system for operation thereof at at least said first and second speeds.

14. A printing system according to claim 13, wherein said speed profile is one of a plurality of speed profiles stored in said memory, and said processor is adapted to select one of said plurality of speed profiles and generate a control signal corresponding to said selected one of said plurality of speed profiles for communication to said variable-speed compiling system.

15. A printing system according to claim 14, wherein said control system includes a print job-receiving module adapted to receive at least sheet media data corresponding to an associated print job with said controller selecting one of said plurality of speed profiles based at least in part on said sheet media data.

16. A printing system according to claim 15, wherein said sheet media data includes data corresponding to at least one of media size, media weight and media material, and said controller is operative to select said one of said plurality of speed profiles based at least in part on said data corresponding to at least one of media size, media weight and media material.

17. A printing system according to claim 12, wherein said control system is operative to maintain displacement of said sheet-engaging surface of said variable-speed compiling system about said axis at approximately said second speed at least until the leading edge of the sheet entering said collection tray is approximately aligned with said first registration surface.

18. A printing system according to claim 12, wherein said control system is operative to operate said variable-speed compiling system such that said sheet-engaging surface is displaced about said axis at a third speed after at least approximately aligning the leading edge of the sheet with said first registration surface.

19. A printing system according to claim 12, wherein said variable-speed compiling system includes a rotational output device drivably connected to said sheet-engaging element.

20. A printing system according to claim 19, wherein said control system is adapted to generate control signals for operating said variable-speed compiling system at said first and second speeds, and said rotational output device is in communication with said control system and adapted to receive said control signals therefrom for generating rotational output corresponding to at least said first and second speeds.

21. A printing system according to claim 12, wherein said collection tray includes a second registration surface disposed transverse to said first registration surface and in approximate alignment with said direction of travel, and said variable-speed compiling system is operative to approximately align the longitudinal edge of the sheet entering said collection tray with said second registration surface.

22. A printing system according to claim 21, wherein said variable-speed compiling system is operative to approximately align the longitudinal edge of the sheet with the second registration surface while operating at said second speed and while maintaining frictional engagement with the sheet.

23. A printing system comprising:

a sheet media source adapted to selectively dispense sheet media;

at least one printing engine in operative communication with said sheet media source and adapted to receive sheet media therefrom, said at least one printing engine being adapted to output marked sheet media;

a media transport pathway disposed in operative communication with said sheet media source and said at least one printing engine, said media transport pathway adapted to transport sheet media from said sheet media source to said at least one printing engine and to transport sheet media away from said at least one printing engine in a direction of travel such that the sheet media have a leading edge, a trailing edge and at least one longitudinal edge extending therebetween;

a finishing unit disposed in operative communication with said media transport pathway and adapted to receive sheet media from said media transport pathway, said finishing unit including:

a collection tray including a first registration surface disposed approximately transverse to said direction of travel, said collection tray adapted to receive sheet media such that the leading edge thereof would be disposed toward said first registration surface; and, a variable-speed compiling system including a sheet-engaging element and a rotational output device drivably connected to said sheet-engaging element, said sheet-engaging element including an axis and a sheet-engaging surface displaceable about said axis, said sheet-engaging element being positioned along said collection tray and operative to frictionally engage a sheet of the sheet media entering said collection tray, said variable-speed compiling system operative to displace said sheet-engaging surface about said axis at at least a first speed and a second speed that is less than said first speed; and, a control system in communication with at least said finishing unit, said control system operative to:

determine arrival of a sheet of sheet media at said finishing unit;

operate said sheet-engaging element of said variable-speed compiling system such that said sheet-engaging surface is displaced about said axis at said first speed prior to said sheet-engaging element frictionally engaging the sheet entering said collection tray as well as after said sheet-engaging element frictionally engages the sheet entering said collection tray;

operate said sheet-engaging element of said variable-speed compiling system such that said sheet-engaging surface is displaced about said axis at said second speed after frictionally engaging the sheet entering said collection tray and thereby decelerating the sheet prior to the leading edge of the sheet contacting said first registration surface;

operate said sheet-engaging element of said variable-speed compiling system such that said sheet-engaging surface is displaced about said axis to at least approximately align the leading edge of the sheet with said first registration surface; and, operate said sheet-engaging element of said variable-speed compiling system such that said sheet-engaging surface is displaced about said axis at a third speed that is less than said second speed after at least approximately aligning the leading edge of the sheet with said first registration surface and while said sheet-engaging element remains in frictional engagement with the sheet.

24. A printing system according to claim 23, wherein said control system is adapted to generate control signals for operating said variable-speed compiling system at said first and second speeds, and said rotational output device is in communication with said control system and adapted to receive said control signals therefrom for generating rotational output corresponding to at least said first and second speeds of said sheet-engaging element.

25. A printing system according to claim 23, wherein said collection tray includes a second registration surface disposed transverse to said first registration surface and in approximate alignment with said direction of travel, and said sheet-engaging element of said variable-speed compiling system is operative to approximately align the longitudinal edge of the sheet with said second registration surface.

26. A printing system according to claim 25, wherein said sheet-engaging element of said variable-speed compiling system is operative to approximately align the longitudinal edge of the sheet with the second registration surface while operating at said second speed and while maintaining frictional engagement with the sheet.

* * * * *